US005786037A

United States Patent [19]

Vergani

[11] Patent Number: 5,786,037

[45] Date of Patent: *Jul. 28, 1998

[54] METHOD FOR PAINTING METAL PLATES

[76] Inventor: Esterina Vergani, Via Roma 6, I-20040 Carnate (Milano), Italy

[ * ] Notice: This patent issued on a continued prosecution application filed under 37 CFR 1.53(d), and is subject to the twenty year patent term provisions of 35 U.S.C. 154(a)(2).

[21] Appl. No.: 662,620

[22] Filed: Jun. 13, 1996

[51] Int. Cl.[6] ..... B05D 1/32

[52] U.S. Cl. ..... 427/466; 427/197; 427/203; 427/261; 427/287; 427/374.1; 427/374.4; 427/375; 427/385.5; 427/398.1; 427/409; 427/421; 427/470; 427/475

[58] Field of Search ..... 427/466, 470, 427/475, 197, 203, 261, 287, 374.1, 374.2, 374.4, 375, 385.5, 398.1, 409, 421

[56] References Cited

U.S. PATENT DOCUMENTS 4,152,284 5/1979 Morlock et al. ..... 252/182
5,063,085 11/1991 Yamane et al. ..... 427/398.1 X

*Primary Examiner*—Bernard Pianalto
*Attorney, Agent, or Firm*—Herbert Dubno; Yuri Kateshov

[57] ABSTRACT

The method for painting metal plates and. sections includes the steps of pre-treating the section surfaces for preparing the surfaces for painting, distributing a first paint on the section, bringing the section to a first temperature for a time adapted to start a polymerization process of the first paint, cooling the section in order to stop the polymerization process at a selected phase, distributing a second paint at selected locations of at least one surface covered with the first paint which is different from the second paint, bringing the section to a final temperature for a selected time required for the complete polymerization of the first and second paints.

5 Claims, 1 Drawing Sheet

METHOD FOR PAINTING METAL PLATES

FIELD OF THE INVENTION

The present invention relates to a method of and a device for painting metal plates and sections.

BACKGROUND OF THE INVENTION

It is known to prepare sheets and sections for painting with a pre-treatment which, for example in the case of aluminum sections, consists of degreasing and washing the section and a subsequent phosphochromate or chromate treatment for enabling the pigment (powder paint) to adhere to the surface.

The treated section is then washed, dried and painted.

The painting process is performed at sites where the powder is electrically charged in order to obtain a perfect adhesion between the powder and the section surface.

The section is completely covered by the powder and introduced into an oven where the powder is polymerized so that it melts and completely covers the section.

The section is then removed from the oven and the paint is allowed to dry.

It is apparent that it is not possible to provide sections with one or more of the surfaces painted with different colors or such that the paints define different patterns on the same surface.

To obviate this inconvenience, adhesive films have been proposed. The adhesive film has a graphic representation on one face and is applied to the painted section surface, with different methods, in order to give a new aesthetic appearance to the section.

Considering that the section has to be packaged, stored and then shipped to the final destination, it is apparent that these adhesive films may easily tear even before the sections are installed.

The application of these films is also very expensive and difficult and entails further working steps on the painted section.

OBJECTS OF THE INVENTION

The subject of the present invention is to eliminate the above described drawbacks of the prior art.

An important object of the invention is to provide a method of and a device for painting metal plates and sections without applying films or any other added materials.

A further object of the invention is to provide a method of and a device for painting metal plates and sections which can use the present plants and apparatus without the need to modify them.

Still a further object of the invention is to provide a method of and a device for painting metal sections with one or more colors and with any type of pattern adapted to provide an improved aesthetic appearance, for example a "wood" appearance.

Still a further object of the invention is to provide a method of and a device for painting metal sections at such a low cost as to not substantially modify the overall cost of the sections which can still be competitive on the market.

SUMMARY OF THE INVENTION

These objects are achieved by a method for painting metal plates and sections which comprises the steps of treating the section surfaces for preparing the surfaces for painting, distributing a first paint on said section, bringing said section to a first temperature for a time adapted to start a polymerization process of said first paint, cooling said section in order to stop said polymerization process at a selected phase, distributing a second paint at selected locations of at least one surface covered with said first paint which is different from said second paint, bringing said section to a final temperature for a selected time required for the complete polymerization of said first and second paints.

The above method is performed by a device for painting metal plates and sections, which comprises: a matrix having a pattern to be reproduced on a section, and penetration means for allowing a selected quantity of paint to penetrate said matrix in order to be deposited on said section according to said pattern.

BRIEF DESCRIPTION OF THE DRAWING

Further characteristics and advantages of the invention will be more apparent by the description of a preferred but not exclusive embodiment of a method and a device for painting metal plates and sections, according to the invention, illustrated, by way of example in the accompanying drawing wherein.

Figure 1:
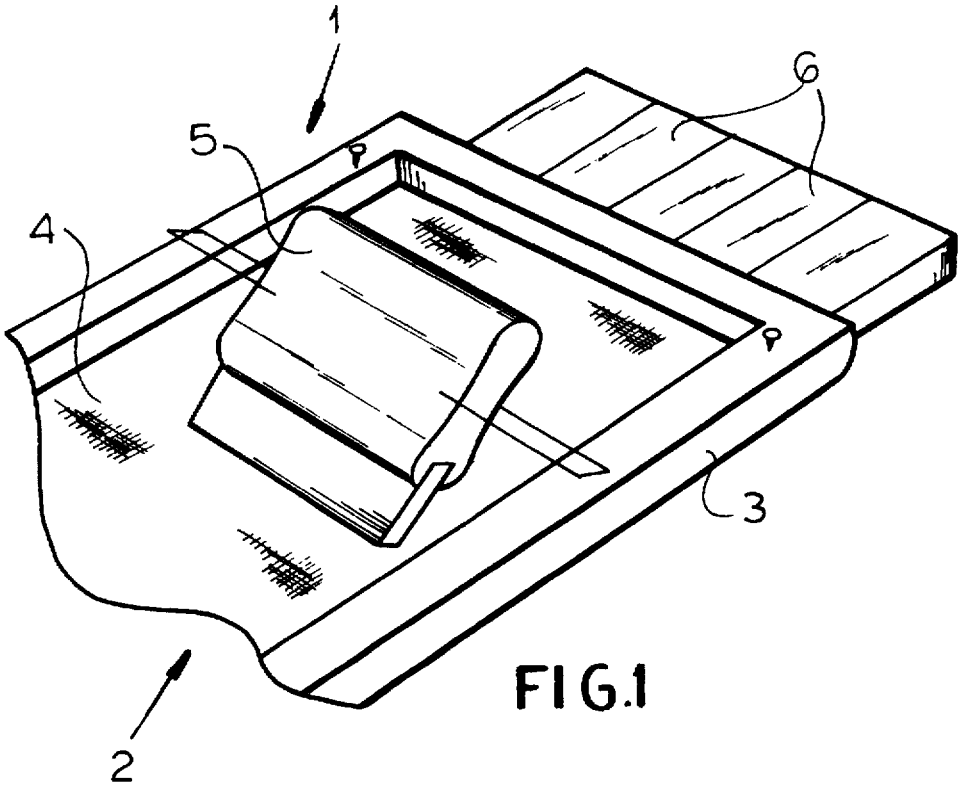
FIG. 1 is a fragmentary schematic perspective view of a device for painting metal sections, according to the invention.

With reference to the figures, the method according to the invention has the following steps.

At first, as is known in the prior art, each metal section and/or plate is pre-treated for the subsequent painting operation by pretreating a surface of a metallic piece so as to cause a powder paint to adhere to the surface.

For example in the case of aluminum sections, the section is usually subjected to degreasing, washing, and phosphochromnating or chromating for enabling the paint to adhere to its surface.

The section is then again washed and dried.

The pre-treated plate or section is then introduced into a painting booth, or other adapted location, and a first powder paint is sprayed on the section. The powder paint is electrically charged in order to make it adhere to all the surfaces of the section to be painted.

The coated section is inserted into an oven and brought to a preset initial temperature for the time required for the first paint to start its polymerization.

As soon as the polymerization process has started, the section is removed from the oven and cooled down in order to stop the polymerization process at a stage when the paint has completely melted and has been uniformly spread over the entire surface of the section.

When the paint and the section are at ambient temperature, at least a second paint is spread on the first paint according to a desired pattern. The second paint has a different hue from the first paint and may be spread on one or more of the previously painted surfaces of the section.

After this stage, the section is again inserted into the oven and brought to a final temperature for a time required for the complete polymerization of both the first paint and the second paint.

Furthermore, the first powder paint is previously electrically charged for a perfect adhesion to the section while the second paint is deposited on the first paint with an electrical charge which is less than the electrical charge of the first paint.

The first and second paints may conveniently have the same resin.

The pattern or design made by the second paint is obtained by passing the second paint through open meshes of a pattern formed on a net fabric laid on the section.

Namely, after laying a matrix, having the pattern to be reproduced, on one or more sections, so arranged as to form one surface, the second paint is spread over the first paint by forcing the second paint through the meshes of the fabric.

The quantity of paint may be varied by varying the size of the open meshes.

In order to bring the first paint to a semipolymerization, the painted section has to reach a temperature comprised between 170° C. and 200° C., for a time in the oven comprised between 30 seconds and 2 minutes, according, of course, to the type of paint.

The initial temperature may be diminished by increasing the time in the oven. In other words, it is possible to vary the initial temperature and the time in the oven to reach the semipolymerization of the first paint. For example, the temperature may he lowered to 100° C. for about 20 minutes, regardless of the thickness of the paint.

The final temperature, at which the first and second paints polymerize, is comprised between 170° C. and 220° C. for a time comprised between 15 and 25 minutes.

Preferably, the final temperature is about 200° C. and the time in the oven at this temperature is about 15 minutes.

The second paint is distributed over the metal sections by means of a device according to the present invention.

Figure 2:
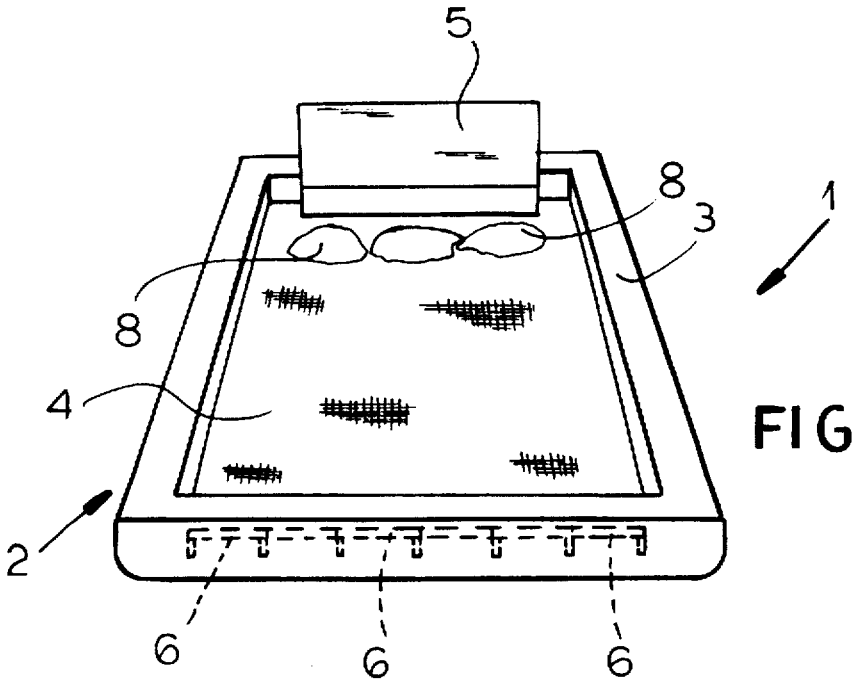
FIG. 2 is a perspective front view of the device arranged on the sections to be painted.

The device, schematically shown in FIGS. 1 and 2 and generally designated by the reference numeral 1, comprises a matrix 2 having a pattern 8 to be reproduced on the section and a penetration means adapted to let a selected quantity of powder paint pass through the matrix and on the surface of the section which has been previously painted with a first paint of different color.

Namely, the matrix comprises a frame 3 and a net fabric 4 laid upon the frame. The meshes of the fabric are sealed except for those meshes defining the pattern to be reproduced on the section.

In this manner, by means of the penetration means, and preferably by means of a brush or rubber squeegee or palette-knife, the second paint is forced through the open meshes of the net fabric and spread over the section 6 in the desired manner.

By conveniently varying the size of the meshes, more or less powder paint may be made to pass through the fabric thus varying the resolution, the texture and the contrast of the pattern on the sections.

It has been seen in practice that the method and the device for painting metal plates and sections, according to the invention, are particularly advantageous for painting patterns of any type on metal sections thus varying their aspect.

For example, if the metal sections are painted brown, it is possible to paint nodes and grains on the brown underground to imitate wood, thus obtaining a section having the aspect of a wooden section but with all the advantages in terms of mechanical resistance, corrosion resistance and duration of the metal sections.

The method and device according to the invention may have numerous modifications and variations, all within the inventive concept.

Furthermore, all the details may be substituted with technically equivalent elements.

The materials employed, as well as the dimensions, may be any according to the specific needs and the state of the art.

Where technical features mentioned in any claim are followed by reference signs, those reference signs have been included for the sole purpose of increasing the intelligibility of the claims and accordingly, such reference signs do not have any limiting effect on the scope of each element identified by way of example by such reference signs.

I claim:

1. A method of painting a metallic piece in the form of a metal plate or section comprising the steps of:

a) pretreating a surface of a metallic piece so as to cause a powder paint to adhere to the surface;

b) thereafter distributing a first layer of a powder paint on said surface of the metallic piece, said power paint consisting of a meltable and polymerizable powder;

c) thereafter inserting the metallic piece into an oven to heat said surface to a preset temperature to melt the first layer of said powder paint, thereby uniformly spreading the first layer of said powder paint over the surface to be coated;

d) maintaining said surface of the metallic piece in said oven at said preset temperature for a first time period sufficient for said powder to begin polymerization;

e) immediately after the beginning of polymerization removing said metallic piece from said oven and thereby cooling said surface to stop polymerization in step (d);

f) thereafter depositing a second layer of a meltable polymerizable powder paint on said surface of the metallic piece over at least part of the first layer; and g) thereafter heating said surface covered with first and second layers of the powder paint to a final temperature and maintaining said final temperature for a second time period effective and sufficient for complete polymerization of the first and second layers of the powder paint.

2. The method defined in claim 1 wherein said first and second layers of the powder paint contain particles of the same type of resin.

3. The method defined in claim 1 wherein said distributing of said first layer of powder paint includes a step of electrically charging said first layer with a first electric charge, thereby adhering said first layer of powder paint to said surface of the metallic piece, said depositing step (f) of said second layer including a step of electrically charging said second layer with a second electrical charge which is lower than said first electrical charge.

4. The method defined in claim 1 wherein said preset temperature varies between 170° C. and 200° C., said first time period lasts between 30 seconds and 2 minutes, said final temperature varies between 170° C. and 220° C., and said second time period lasts between 10 minutes and 25 minutes.

5. A method of painting of a metallic piece of a metal plate or section comprising the steps of:

a) pretreating a surface of a metallic piece so as to cause a powder paint to adhere to the surface;

b) thereafter distributing a first layer of a powder paint on the surface of the metallic piece, said power paint consisting of a meltable and polymerizable powder;

c) thereafter inserting the metallic piece into an oven to heat the surfaces to a preset temperature to melt the first layer of the powder paint, thereby uniformly spreading the first layer of the powder paint over the surface to be coated;

d) maintaining the surface of the metallic piece in the oven at the preset temperature for a first time period sufficient for the powder paint to begin polymerization e) immediately after the beginning of polymerization removing said metallic piece from said oven and thereby cooling said surface to stop polymerization in step (d);

f) laying a matrix on the first layer;

g) forcibly spreading a second layer of the powder paint on the surface of the metallic piece over the first layer through the matrix to obtain a desired pattern on the surface; and (h) thereafter heating said surface covered with first and second layers of the powder paint to a final temperature and maintaining said final temperature for a second time period effective and sufficient for complete polymerization of the first and second layers of the powder paint.

* * * * *